United States Patent [19]

Yakuwa

[11] Patent Number: 4,611,565

[45] Date of Patent: Sep. 16, 1986

[54] BACKUP SYSTEM FOR ELECTRONIC FUEL INJECTION CONTROL SYSTEM

[75] Inventor: Masahiko Yakuwa, Saitama, Japan

[73] Assignee: Honda Giken Kogyo Kabushiki Kaisha, Tokyo, Japan

[21] Appl. No.: 725,591

[22] Filed: Apr. 22, 1985

[30] Foreign Application Priority Data

May 25, 1984 [JP] Japan ..... 59-75937[U]

[51] Int. Cl.[4] ..... F02M 51/00

[52] U.S. Cl. ..... 123/479; 123/491

[58] Field of Search ..... 123/478, 479, 491

[56] References Cited

U.S. PATENT DOCUMENTS

| | | | |
|---|---|---|---|
| 4,221,194 | 9/1980 | Wright | 123/478 |
| 4,369,748 | 1/1983 | Steinke et al. | 123/478 X |
| 4,378,771 | 4/1983 | Sawada et al. | 123/479 X |
| 4,478,186 | 10/1984 | Bauer et al. | 123/478 |

*Primary Examiner*—Willis R. Wolfe, Jr.
*Attorney, Agent, or Firm*—Pollock, VandeSande and Priddy

[57] ABSTRACT

A backup system for an electronic fuel injection control system as for an internal combustion engine, which has the ability, when the electronic fuel injection control device fails to function normally or when there arises the possibility of inducing this failure, to control the duration of the opening of the injector's valve and consequently the volume of fuel to be injected to the extent of permitting the start of the internal combustion engine without recourse to the signal from the sensor system now out of order or the operation of the electronic control device, and thus is capable of controlling the internal combustion engine without obstructing the operation of starting, warming-up and cruising in the case of the aforementioned trouble.

10 Claims, 8 Drawing Figures

+V
R9
b
R10
3
2
a
1
c
4a
R1
R2
4
5
6a
e
6
7a
Eref
R4
R3
7
f
8
10
9
a
30
13
14a
14
+V
R7
R8
$R_T$
$R_L$
15
R5
R6
d
20
12
11
TDC +V
b
3
2
a
1
c
4a
R1
R2
4
5
e
6a
6
7a
R3
Eref
R4
7
f
8
10
9
a
30
INVERTER
50
40
MV
d
20
12
11
TDC

BACKUP SYSTEM FOR ELECTRONIC FUEL INJECTION CONTROL SYSTEM

BACKGROUND OF THE INVENTION (1) Field of the Invention

This invention relates to a backup system for an electronic system used in controlling the fuel injection time, and more particularly to a backup system for an electronic fuel injection time control system as for an internal combustion engine, which is intended to aid the said electronic control system in effecting the control of fuel injection time when the control system fails to operate normally or when there arises the possibility of inducing this failure.

(2) Description of the Prior Art

Recently, vehicles furnished with an electronic fuel injection control system have been in the process of being commercialized. For the control of the fuel injection time on these vehicles, an electronic control device such as the microcomputer is customarily used.

This electronic control device, however, has the disadvantage that when a problem arises, such as a fall in the voltage of the battery feeding power to the electronic control device or a malfunction in the sensor system feeding data to the electronic control system so that, as the result, the electronic control device fails to function normally, the feed of fuel to the engine becomes abnormal and the operational performance of the engine suffers.

BRIEF SUMMARY OF THE INVENTION

An object of this invention is to provide a backup system for an electronic fuel injection control system, which has the ability, when the electronic fuel injection control device fails to function normally or when there arises the possibility of inducing this failure, to control the duration of the opening of the injector's valve and consequently the volume of fuel to be injected to the extent of permitting the start of the internal combustion engine without recourse to the signal from the sensor system now out of order or the operation of the electronic control device.

Another object of this invention is to provide a backup system for an electronic fuel injection time control system, which is capable of controlling the internal combustion engine without obstructing the operation of starting, warming-up and cruising in the case of the aforementioned trouble.

DETAILED DESCRIPTION OF THE INVENTION

Now, one embodiment of the present invention will be described below with reference to the accomanying drawings.

Figure 1:
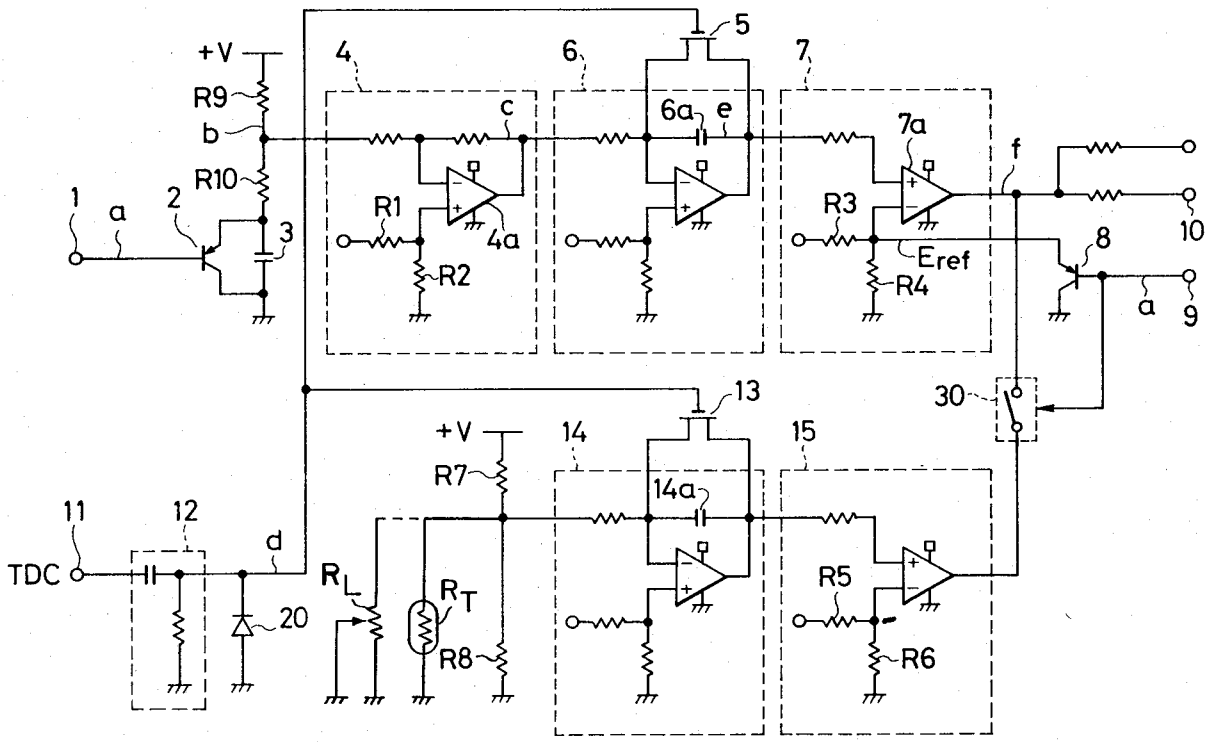
FIG. 1 is a circuit diagram illustrating one embodiment of this invention.

In FIG. 1, numerals 1 and 9 denote a first and a second input terminal to which a start switch signal is fed, 2 and 8 denote transistors for switching, 3 denotes a capacitor, 4 denotes an arithmetic circuit including a differential amplifier circuit, and 5 and 13 denote MOS type FET transistors for switching (hereinafter referred to simply as 'FET').

Numerals 6 and 14 denote a first and a second integrator, 7 and 15 denote a first and a second comparator, 10 denotes an output terminal, 11 denotes a third input terminal to which is applied a pulse signal (TDC signal) that is generated, for example, at an angle of 30° preceding the upper top dead center of each cylinder, 12 denotes a differentiating circuit, 20 denots a diode, and 30 denotes a switching circuit.

The rectangular wave output which appears at the output terminal 10 is fed, upon detection of the failure of the aforementioned electronic fuel injection time control device (not shown) to function normally or the possibility of the control device inducing this failure, to a drive circuit for the fuel injector (not shown) in place of the output from the aforementioned electronic fuel injection control device.

Figure 2:
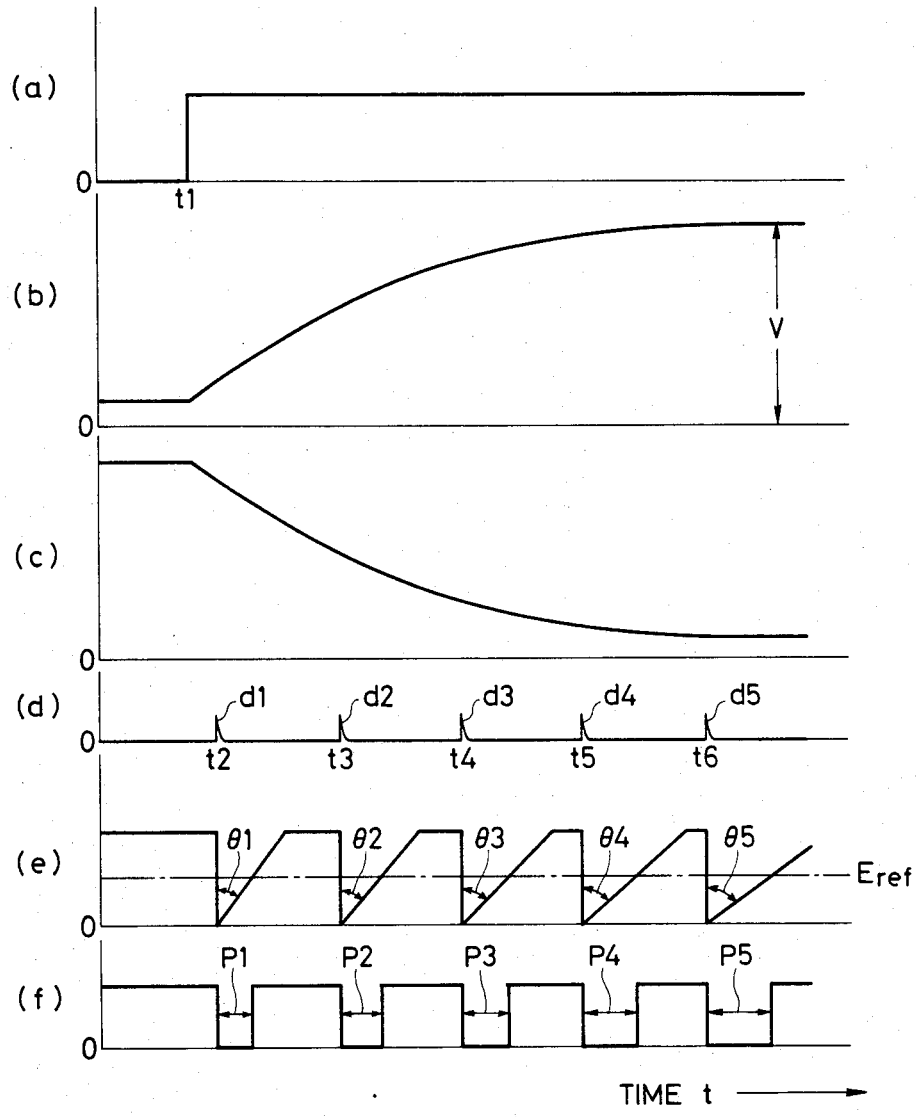
FIGS. 2 (*a*)-(*f*) are time charts illustrating typical signal waveforms generated in various parts of the configuration of FIG. 1.

FIGS. 2 (*a*)-(*f*) are time charts illustrating typical signal waveforms generated in various parts of the configuration of FIG. 1. The waveforms of FIGS. 2 (*a*)-(*f*) represent the signals which appear respectively at the positions denoted by these alphabetic letters in FIG. 1.

When the electronic fuel injection control device, during the course of its operation, develops an abnormal condition or the voltage of the power source is lowered and, as the result, the state in which the normal control of fuel injection by the electronic control device is no longer obtained is detected, a suitable conventional control means applies a voltage +V to the backup device of this invention as shown in FIG. 1.

When a starter switch is turned on at the time t1 in this state, a start switch signal of a high level as shown in FIG. 2 (*a*) is fed to the first and second input terminals 1, 9.

As the result, the transistors 8, 2 are turned off. As the transistor 2 is turned off, the capacitor 3 begins to be charged by the voltage +V through voltage dividing resistances R9, R10. To the inverted input (−) terminal of an operational amplifier 4*a* constituting the arithmetic circuit 4, therefore, a signal which begins to rise gradually at the time t1 is fed. This state is depicted by the waveform (b) of FIG. 2.

The arithmetic circuit 4 compares the aforementioned signal (b) with the reference voltage on the non-inverted input (+) terminal side which is determined by the voltage dividing resistances R1, R2 on the non-inverted input (+) terminal of the operational amplifier 4*a* to produce a difference signal.

As the result, the arithmetic circuit 4 of the present embodiment feeds out a voltage signal which, conversely to the input signal (b), begins to fall gradually at the time t1. This state is depicted by the waveform (c) of FIG. 2. This voltage signal (c) is fed to the first integrator 6.

To the gate of the FET 5 the source and drain of which are connected to the opposite terminals of the integrating capacitor 6*a*, pulse signals d1, d2, . . . indicated by the waveforms (d) of FIG. 2 are kept applied. The pulse signals (d) are obtained by subjecting the TDC signal applied to the third input terminal 11 to differentiation in the differentiating circuit 12 and clipping the negative components of the products of differentiation with the diode 20.

As the result, the FET 5 is kept on only for a brief period during which the aforementioned pulse signals (d) are applied.

When the pulse signal d1 of FIG. 2 (*d*) is applied to the gate of the FET 5 at the time t2 while the voltage signal (c) from the arithmetic circuit 4 is kept fed to the first integrator 6, the charge accumulated up to that time in the capacitor 6*a* of the first integrator 6 (namely the integrated output) is instantaneously discharged via the aforementioned FET 5. In other words, the output of the first integrator 6 is returned to its initial value, namely reset to the 0 level.

The output of the first integrator 6, therefore, abruptly falls to the 0 level at the time t2 as shown by the waveform (e) of FIG. 2. Since the FET 5 immediately reverts to the OFF state then, the first integrator 6 again commences its integrating operation. To be specific, substantially at the time t2, the output of the first integrator 6 increases substantially linearly as shown by the waveform (e) of FIG. 2.

At each of the times t3, t4, t5, and t6 when the pulse signals d2, d3, d4, and d5 indicated in FIG. 2 (*d*) are applied to the gate of the FET 5, the abrupt fall of the integration output to the 0 level and the subsequent substantially linear rise of the output are repeated.

The voltage of the output signal (c) from the aforementioned arithmetic circuit 4, i.e. The input to the first integrator 6, gradually falls with elapse of time as is obvious from the waveform diagram.

The interval between the time when the aforementioned intergration output abruptly falls to the prescribed level (such as, for example, the 0 level) in response to turning on of the FET 5 and the time when the output of the first integrator 6 is raised to a prescribed potential is gradually increased. In other words, the mutual relation among the angles $\theta 1$–$\theta 5$ of FIG. 2 (*e*) is as indicated by the following formula.

$$\theta 1<\theta 2<\theta 3<\theta 4<\theta 5< \quad (1)$$

The output (e) of the first integrator 6 described above is fed to the non-inverted input (+) terminal of an operational amplifier 7*a* constituting the first comparator 7. On the other hand, to the inverted input (−) terminal of the operational amplifier 7*a* is fed the reference voltage $E_{ref}$, which is determined by the voltage dividing resistances R3, R4, as indicated by the chain line in FIG. 2 (*e*).

The output (e) of the first integrator 6, therefore, is compared with the reference voltage $E_{ref}$, in the first comparator 7. As the result, the first comparator 7 feeds out the rectangular wave signal of high level when the potential of the output signal (e) is higher than the reference voltage $E_{ref}$, and of low level when the potential is lower. This state is depicted by the waveform (f) of FIG. 2.

The low level periods, P1, P2, P3, . . . , as clearly noted from the aforementioned formula (1), satisfy the following relation.

$$P1<P2<P3< \quad (2)$$

wherein P1 is substantially equal to a brief period suitable for starting the engine at rather elevated temperature and P4, P5, . . . are long periods suitable for starting it at low temperature.

Thereafter, the rectangular wave signal (f) which is the output from the first comparator 7 is fed via the output terminal 10, for example, to the driver circuit (not shown) of the fuel injector as described above. The duration of the injection of fuel through the injector, namely the duration in which the needle valve of the injector is kept open, is the low level period of the aforementioned rectangular wave signal (f), for example.

When the normal control of fuel injection by the electronic control device is not obtained or when there arises the possibility of inducing this trouble and during the start of the internal combustion engine, the engine is started after the low level period of the aforementioned rectangular wave signal (f) has increased to a value substantially proper for the engine temperature and the air/fuel ratio has decreased to a proper level.

After that , the operator turns the starter switch off. As the result, the starter switch signal (a) of a high level which has been kept applied to the first and second input terminals 1, 9 disappears and the transistors 2, 8 are turned on.

At this time, therefore, the input signal to the arithmetic circuit 4 equals the signal of the prescribed level (determined by the voltage dividing resistances R9, R10) existing before the time t1 of FIG. 2 (*b*). Consequently, the voltage signal which is the corresponding output equals the signal of the prescribed level existing before the time t1 of the same diagram (c).

The first integrator 6 which has received this voltage signal, as easily inferred from the foregoing description, feeds out a signal which falls to zero whenever the pulse signal indicated in FIG. 2 (*d*) is applied to the gate of the FET 5 and immediately rises uniformly at a prescribed angle (gradient) in accordance with the prescribed level of the aforementioned voltage signal (c).

Incidentally, while the starter switch is kept off, the reference voltage of the first comparator 7 is equal to ground potential because the transistor 8 is on and the resistance R4 is short-circuited with it. Even when the first comparator 7 receives the output of the aforementioned first integrator 6, therefore, the output of the first comparator 7 does not form a rectangular wave signal described above but remains always at a high level.

As the result, the output of the first comparator 7 exerts no effect of any sort on the aforementioned duration of fuel injection through the injector after the internal combustion engine has been started and the starter switch has been turned off.

Meanwhile, in FIG. 1, the switch circuit 30 is brought into a closed state at the time the start of the engine is completed, the starter switch is turned off, and the starter switch signal disappears.

After the engine is started, therefore, rectangular wave signals different from the rectangular wave signals mentioned above are formed in the second integrator 14 and the second comparator 15 as described afterward and, by applying these rectangular wave signals to the output terminal 10, the control of the duration of fuel injection through the injector is executed.

Whenever pulse signals similar to those of FIG. 2(*d*) are applied to the gate of the FET 13 the source and drain of which are connected to the opposite ends of the integrating capacitor 14*a* of the second integrating circuit 14 while the switch circuit 30 is kept in a closed state, the output of the second integrator 14 is reset. On the other hand, since the input of the second integrator 14 is the second voltage signal, i.e. the signal of a prescribed level scheduled to be generated by the potential divider formed of the resistances R7, R8, the output of /second integrator 14 rises uniformly at a prescribed angle (increment of gradient) immediately after the aforementioned resetting.

The second comparator 15 which has received this rising signal compares the second reference voltage determined by the voltage dividing resistances R5, R6 with the output of the second integrator 14 and feeds out a rectangular wave signal similar to the output from the first comparator 7 during the aforementioned ON status of the starter switch.

In the case of the rectangular wave signal fed out by the second comparator 15, however, since the input to the second comparator 15 is a signal which uniformly rises at a prescribed angle or increment as described above, the low level periods which form intervals for fuel injection have a uniform width. These low level periods are set so that, on completion of warming-up, the fuel is supplied in amounts proper for the travel of the vehicle.

The rectangular wave signals are applied via the switch circuit 30 to the output terminal 10. By these signals, the intervals of fuel injection through the injector are controlled. These rectangular wave signals enable the vehicle to manage continued travel without damaging much of the actual drive-ability of the vehicle until repairs can be made, even though the engine control system itself failed.

In the embodiment described above, the first voltage signal fed to the first integrator 6 has been described as being produced by the capacitor 3 and the arithmetic circuit 4. This invention is not limited to this particular arrangement. For example, the output of a charging-discharging circuit whose charging is started by the closure of an ignition switch and whose discharging is effected at a fixed time constant by the closure of the starter switch may be adopted as the aforementioned first voltage signal.

Further in the present embodiment, the second voltage signal fed to the second integrator 14 is formed by the voltage divider formed of the resistances R7, R8. It is permissible, for example, to vary the input voltage of the second integrator 14, namely the magnitude of the aforementioned second voltage signal in accordance with the output of a sensor in normal operation or to vary the capacitance of the integrating capacitor as the function of the output of the aforementioned sensor and alter the integrating time constant of the second integrator 14.

In this case, it becomes possible to control the gradient of the output of the second integrator 14 in accordance with the output of the aforementioned normal sensor and, as the result, vary the fuel injection time as the function of the output of the sensor. A similar function can be attained by varying the second reference voltage of the second comparator 15 in accordance with the aforementioned sensor output.

As the sensor for this purpose, a cooling water temperature sensor $R_T$, or a sensor $R_L$ adapted to detect a parameter indicative of an engine load, can be used.

Figure 3:
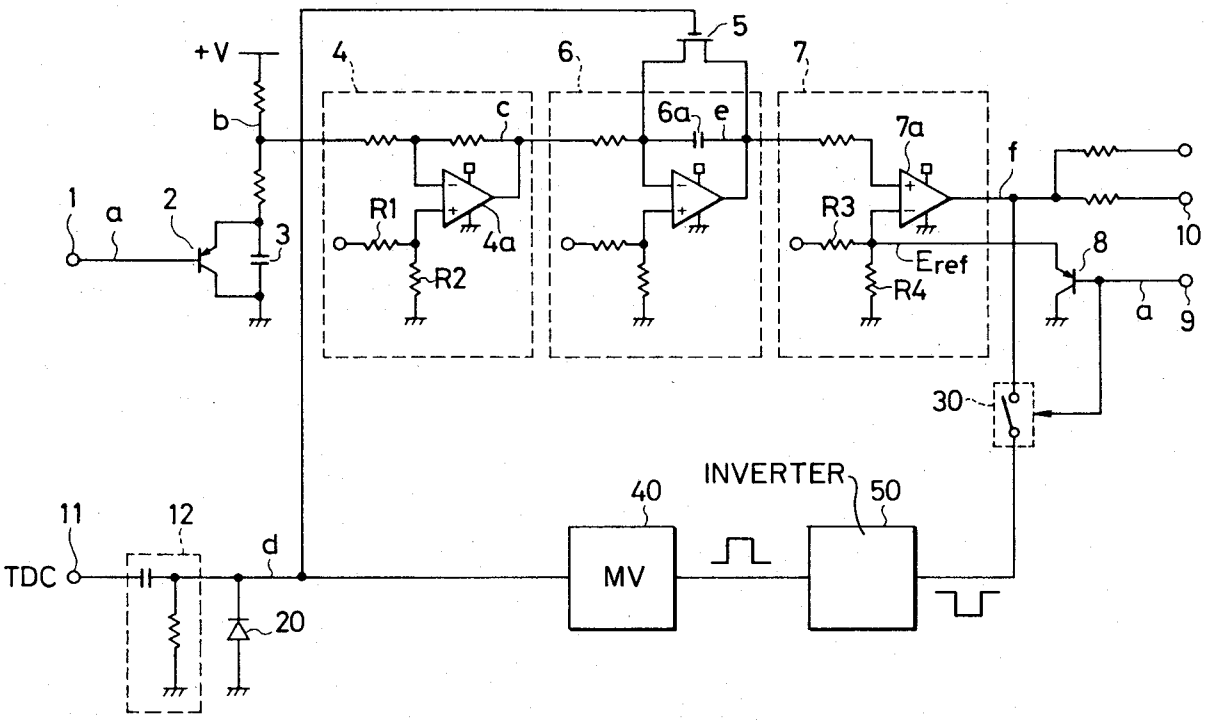
FIG. 3 is a circuit diagram illustrating another embodiment of this invention.

It is also optional to use a monostable multivibrator 40 triggered by the TDC signal and an inverter 50 such as are shown in FIG. 3, in place of the rectangular wave signal generator circuit formed of the aforementioned second integrator 14 and second comparator 15 shown in FIG. 1. In FIG. 3, the same symbols as found in FIG. 1 denote identical or equal parts. Naturally in this case, the duration of the output (low level) of the aforementioned monostable multivibrator can be controlled in accordance with the output of the normal sensor as described above.

In the embodiment illustrated in FIG. 1 and FIG. 3, the switch circuit 30 is incorporated for the purpose of intercepting the rectangular wave signal of the second comparator 15 or inverter 50 when the starter switch is closed. For the present invention, the switch 30 is not an indispensable part. Optionally, this interception may be accomplished e.g. by establishing a direct connection between the outputs of the first and second comparators 7, 15 and the inverter 50 or by feeding the logical sum of these two outputs to the output terminal 10.

This is (1) because the rectangular wave signals issuing from the aforementioned two comparators 7, 15 and the inverter 50 fall to zero in the same timing and, therefore, the times for starting fuel injection by the aforementioned two rectangular wave signals coincide and (2) because the low level duration of the rectangular wave signal issuing from the first comparator 7 is usually given a greater value than the low level duration of the signal issuing from the inverter 50 or the second comparator 15 and, therefore, the state in which the air/fuel ratio of the mixture supplied during the start of the engine is leaner than the required value can be avoided.

It is also possible to actuate the backup system of this invention even while the electronic fuel injection control device is in normal condition, and select the output of the backup system when the ordinary fuel injection control device is or may be out of order.

As is clear from the foregoing description, the present invention, when the electronic fuel injection control device fails to function normally or when there arises the possibility of inducing this trouble, permits the duration of fuel injection through the injector and consequently the amount of fuel so injected to be controlled at respective values not adverse to the start of the engine or to the cruise of the vehicle without recourse to the fuel control signal computed based on the signal from the sensors in the electronic control device.

Thus, the present invention has an effect of enabling, even when the electronic fuel injection time control device goes out of order, to start the engine without fail and cruise the vehicle by its own power to a repair shop. As noted from the foregoing description, it is optional to omit the second integrator 14, the second comparator 15, the monostable multivibrator 40, the inverter 50 and the switch 30 from the construction shown in FIGS. 1 and 3.

What is claimed is:

1. A backup system for an electronic fuel injection system operative to control the injectors of a vehicle fuel injection system to an extent sufficient to permit the starting of the internal combustion engine of the vehicle when the electronic fuel injection control system of the vehicle fails or functions abnormally, comprising voltage signal generating means for generating a voltage signal the magnitude of which gradually varies from the time of closure of a starter switch, an integrating circuit for receiving and accumulating said gradually varying voltage signal, a comparator for comparing the output from said integrating circuit with a reference voltage and issuing a rectangular wave signal possessing a waveform conforming to the outcome of said comparison, means for resetting the output of said integrating circuit to the initial value thereof in response to the occurrence of a TDC signal, and means for feeding the output of said comparator to an injector thereby to regulate the duration of the opening of a valve of said injector.

2. A backup system for an electronic fuel injection control system, comprising voltage signal generating means for generating a voltage signal the magnitude of which gradually varies from the time of closure of a starter switch, said voltage signal generating means being operative to produce an output voltage signal which constitutes a differential voltage obtained by comparing the value of said gradually increasing voltage signal with a reference voltage of predetermined level, an integrating circuit for receiving said output voltage signal and for accumulating said output voltage signal, a comparator for comparing the output from said integrating circuit with a further reference voltage and issuing a rectangular wave signal possessing a waveform conforming to the outcome of said comparison, means for resetting the output of said integrating circuit to the initial value thereof in response to the occurrence of a TDC signal, and means for feeding the output of said comparator to an injector thereby regulating the duration of the opening of a valve of said injector.

3. A backup system for an electronic fuel injection time control system, comprising in combination voltage generating means for generating a voltage signal the value of which gradually varies from the time of closure of a starter switch, an integrating circuit for receiving supply of said voltage signal and accumulating the said voltage signal, a comparator for comparing the output from said integrator circuit with a reference voltage and issuing a rectangular wave signal possessing a waveform conforming to the outcome of said comparison, means for resetting the output of said integrating circuit to the initial value thereof in response to the occurrence of a TDC signal, means for generating a pulse with predetermined duty ratio in response to the occurrence of the TDC signal, and means for feeding the outputs of said comparator and pulse generating means to an injector thereby regulating the duration of the opening of a valve of said injector.

4. A backup system for an electronic fuel injection control system according to claim 3, wherein said pulse generating means comprise a monostable multivibrator triggered by the TDC signal.

5. A backup system for an electronic fuel injection control system according to claim 3, wherein said pulse generating means comprise a monostable multivibrator triggered by the TDC signal and an inverter for inverting an output of said monostable multivibrator.

6. A backup system for an electronic fuel injection control system, comprising in combination voltage signal generating means for generating a first voltage signal the value of which gradually varies from the time of closure of a starter switch, a first integrating circuit for receiving supply of said first voltage signal and accumulating the first voltage signal, a first comparator for comparing the output from said first integrating circuit with a first reference voltage and issuing a first rectangular wave signal possessing a waveform comforming to the outcome of said comparison, a second integrating circuit for receiving supply of a second voltage signal and accumulating the second voltage signal, a second comparator for comparing the output from said second integrating circuit with a second reference voltage and issuing a second rectangular wave signal possessing a wave form conforming to the outcome of said comparison, means for resetting the output of said two integrating circuits to the initial values thereof in response to the occurrence of a TDC signal, and means for feeding the outputs of said two comparators to an injector thereby regulating the duration of the opening of a valve of said injector.

7. A backup system for an electronic fuel injection control system according to claim 6, wherein said first voltage signal issuing from said first voltage signal generating means as an output thereof is a differential voltage obtained by comparing the value of the voltage gradually increasing from the time of closure of said starter switch with a third reference voltage of a prescribed level.

8. A backup system for an electronic fuel injection control system according to claim 6, wherein the level of said second voltage signal fed to said second integrating circuit is a function of the output of a cooling water temperature sensor.

9. A backup system for an electronic fuel injection control system according to claim 6, wherein the level of said second voltage signal fed to said second integrating circuit is a function of the output of a sensor serving to detect a parameter representing an engine load.

10. A backup system for an electronic fuel injection control system according to claim 6, wherein the level of said second voltage signal fed to said second integrating circuit has a substantially fixed value.

* * * * *